US007878101B2

(12) United States Patent
Heldmann et al.

(10) Patent No.: US 7,878,101 B2
(45) Date of Patent: Feb. 1, 2011

(54) WEAPON STORAGE AND LOADING SYSTEM WITH ROCKET LAUNCHER AND AMMUNITION COMPARTMENT FOR STORING ROCKET CONTAINERS

(75) Inventors: Heinrich Heldmann, Kassel (DE); Siegfried Süss, Niestetal (DE); Georg Scheidemann, Udenborn (DE)

(73) Assignee: Krauss-Maffei Wegmann GmbH & Co. KG (DE)

( * ) Notice: Subject to any disclaimer, the term of this patent is extended or adjusted under 35 U.S.C. 154(b) by 381 days.

(21) Appl. No.: 11/836,708

(22) Filed: Aug. 9, 2007

(65) Prior Publication Data

US 2008/0156182 A1 Jul. 3, 2008

(30) Foreign Application Priority Data

Aug. 10, 2006 (DE) ..... 10 2006 037 337

(51) Int. Cl.
*F41A 9/00* (2006.01)

(52) U.S. Cl. ..... 89/1.801; 89/1.805; 89/45

(58) Field of Classification Search ..... 89/45, 89/46, 1.801–1.805, 1.815, 1.8–1.82
See application file for complete search history.

(56) References Cited

U.S. PATENT DOCUMENTS

| | | | | | |
|---|---|---|---|---|---|
| 380,688 | A | * | 4/1888 | Murray | 89/46 |
| 658,244 | A | * | 9/1900 | Dawson et al. | 89/46 |
| 879,387 | A | * | 2/1908 | Ihider | 89/46 |
| 1,051,056 | A | * | 1/1913 | Bachelet | 89/46 |
| 2,456,620 | A | * | 12/1948 | Chadwick et al. | 89/45 |
| 2,592,790 | A | * | 4/1952 | Brereton | 89/45 |
| 2,745,317 | A | * | 5/1956 | Stanton et al. | 89/46 |
| 2,770,169 | A | * | 11/1956 | Gerdin | 89/45 |
| 2,779,245 | A | * | 1/1957 | Smith | 89/45 |
| 2,788,713 | A | * | 4/1957 | Even | 89/45 |
| 2,833,431 | A | * | 5/1958 | Bole | 89/46 |
| 2,855,828 | A | * | 10/1958 | Girouard et al. | 89/45 |
| 2,984,157 | A | | 5/1961 | Johnstone | |
| 2,985,072 | A | * | 5/1961 | Carlberg et al. | 89/45 |
| 2,994,248 | A | * | 8/1961 | Carlberg et al. | 89/45 |
| 3,095,780 | A | * | 7/1963 | Bauer et al. | 89/1.805 |
| 3,162,088 | A | * | 12/1964 | Landstrom | 89/45 |
| 3,173,334 | A | * | 3/1965 | Landstrom | 89/1.802 |
| 3,180,224 | A | * | 4/1965 | Linke | 89/1.801 |
| 3,228,293 | A | * | 1/1966 | Kane et al. | 89/45 |
| 3,228,295 | A | * | 1/1966 | Kane et al. | 89/1.802 |
| 3,276,321 | A | * | 10/1966 | Kane et al. | 89/46 |

(Continued)

FOREIGN PATENT DOCUMENTS

| | | |
|---|---|---|
| GB | 2199550 | 7/1988 |

*Primary Examiner*—Michael Carone
*Assistant Examiner*—Jonathan C Weber
(74) *Attorney, Agent, or Firm*—Robert W. Becker; Robert W. Becker & Associates

(57) ABSTRACT

A weapon system, especially for a ship, having a rocket launcher and an ammunition compartment for storing rocket containers designed to each accommodate at least one rocket. Disposed in the ammunition compartment is a guide mechanism on which at least two ammunition carriages, designed to accommodate the rocket containers, are displaceably disposed, whereby they can be shifted out of a parked position into a loading position in which the rocket container is disposed essentially below a slide-in structure of the rocket launcher. Securing mechanisms are provided for securing the ammunition carriages in place on the guide mechanism.

14 Claims, 10 Drawing Sheets

U.S. PATENT DOCUMENTS 3,316,808 A * 5/1967 Mais ..... 89/1.804
3,368,451 A * 2/1968 Bauer et al. ..... 89/1.802
3,376,785 A * 4/1968 Elwin ..... 89/46
4,208,949 A * 6/1980 Boilsen ..... 89/1.815
4,362,459 A * 12/1982 Klausbruckner et al. ... 89/1.815
4,438,677 A * 3/1984 Spotzl et al. ..... 89/47
4,580,482 A * 4/1986 Grunewald et al. ..... 89/34
4,593,600 A 6/1986 Kaustrater
4,662,264 A 5/1987 Kaustrater
4,846,627 A * 7/1989 Steuart ..... 414/800
H683 H * 10/1989 Brubaker ..... 89/1.805
4,974,492 A * 12/1990 Baus et al. ..... 89/46
5,526,730 A * 6/1996 Zangrando ..... 89/46
5,682,005 A * 10/1997 Crowley ..... 89/1.815
5,837,922 A * 11/1998 Maher et al. ..... 89/46
6,026,729 A * 2/2000 Hallqvist ..... 89/46
6,481,328 B1 * 11/2002 Hallqvist ..... 89/46
6,584,881 B1 * 7/2003 Boudreau et al. ..... 89/1.815
6,679,159 B1 * 1/2004 Hullett ..... 89/46
2008/0156182 A1 * 7/2008 Heldmann et al. ..... 89/1.804

* cited by examiner

A-A

WEAPON STORAGE AND LOADING SYSTEM WITH ROCKET LAUNCHER AND AMMUNITION COMPARTMENT FOR STORING ROCKET CONTAINERS

The instant application should be granted the priority date of 10 Aug. 2006 the filing date of the corresponding German patent application DE 10 2006 037 337.5.

BACKGROUND OF THE INVENTION

The present invention relates to a weapon system, especially for a ship, and includes a rocket launcher and an ammunition compartment for storing rocket containers designed to accommodate at least one rocket.

Such systems are known in general. The stored rocket containers with the rockets are supplied to the rocket launcher, which fires the thus-loaded rockets. Subsequently, the empty rocket containers must again be removed or deposited, and new rocket containers filled with rockets must be supplied to the rocket launcher. Therefore, an ammunition storing system is required that is suitable for supplying the full rocket containers to the rocket launcher and again removing and storing the empty rocket containers. The number of rockets that can be supplied to the rocket launcher is a function of the design of the rocket launcher. Pursuant to one known design, the rocket launcher can, for example, accommodate two rocket containers, each containing six rockets.

One know rocket launcher that is mounted in a land vehicle is described in EP 1 186 848 A1. Also disclosed here is how the rocket container that is disposed on the ground behind the vehicle is taken up by a crane and supplied to the rocket launcher.

For weapon systems installed on ships, the external influences are always problematic. On the one hand, the systems must be protected against sea and weather conditions (salt water), and on the other hand large forces can act upon the mechanisms due to heavy seas and swells. For this reason the ammunition must be well protected and reliably stowed. At the same time, the space that is, available on the ship is limited.

It is an object of the present application to provide a weapon system that ensures a reliable storage of the ammunition while requiring little space.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
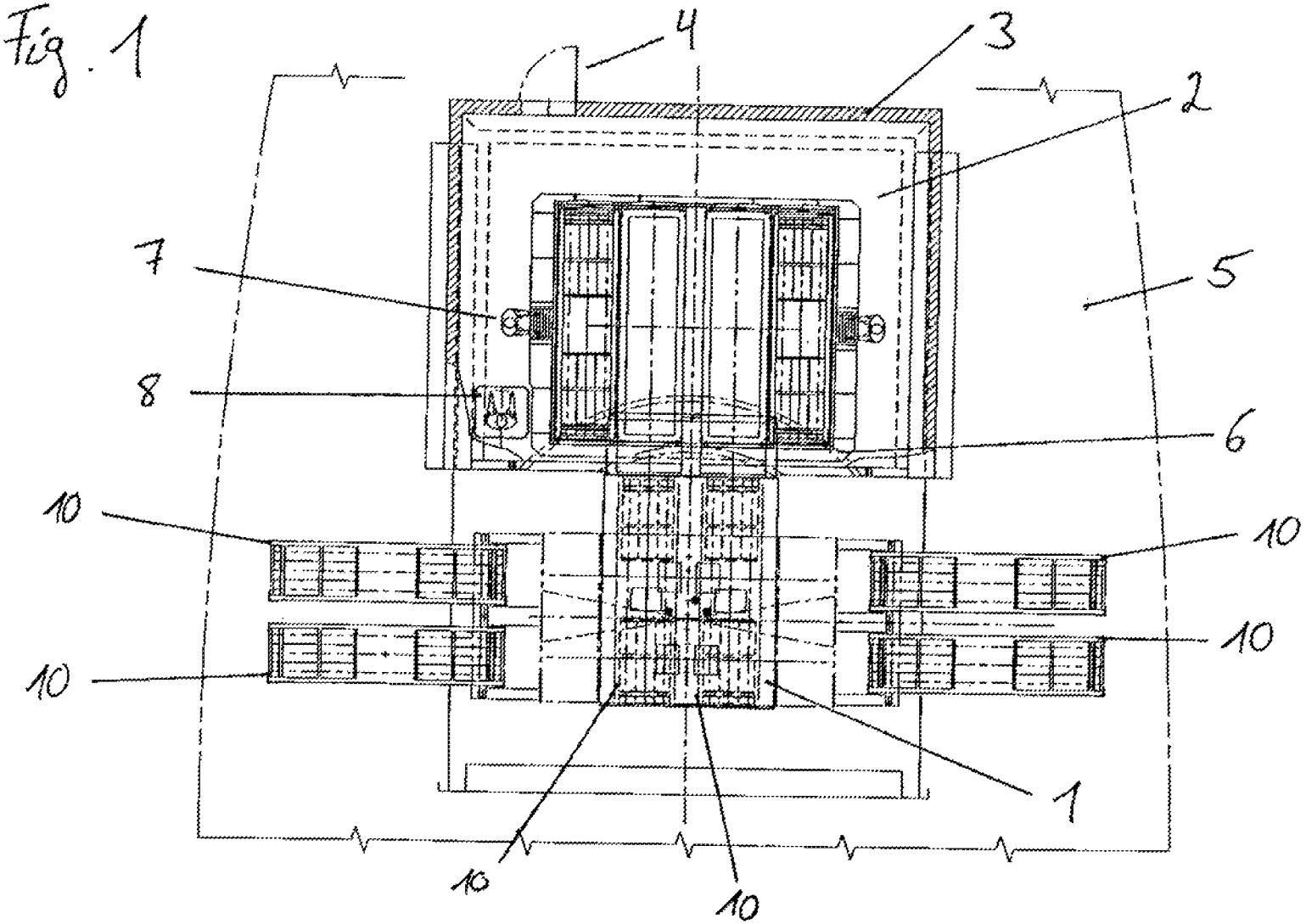
FIG. 1 is a plan view of one exemplary embodiment of a weapon system having a rocket launcher and an ammunition compartment on the deck of a ship during loading of the ammunition compartments.

A basic concept of the present invention is that disposed in the ammunition compartment is a guide mechanism on which at least two ammunition carriages are displaceably disposed. The ammunition carriages serve for accommodating the rocket containers, and they can be shifted out of a parked position into a loading position in which a rocket container is disposed essentially below a slide-in structure of the rocket launcher. To supply the rocket containers to the rocket launcher, an ammunition carriage on which a full rocket container is disposed is shifted from the parked position into the loading position. There the rocket container can, for example by means of a lifting mechanism such as a crane, which can engage a ring or eye of the rocket container, be raised from the ammunition carriage and supplied to the rocket launcher. After firing, the empty rocket containers are again placed upon the ammunition carriage, and the ammunition carriage, together with the empty rocket container, is shifted back into a parked position. Thus, it is possible for a plurality of rocket containers to be stored in a parked position. The guide mechanism makes it possible for the rocket containers on the carriages to be moved on defined tracks or paths within the ammunition compartment. The carriages are protected by securing means, such as bolt securing means, from undesired movements during heavy seas.

The limited space on a ship can be better utilized if in the ammunition compartment at least two guide mechanisms are disposed one above the other, with at least two ammunition carriages being displaceably disposed on each of the guide mechanisms.

Pursuant to a particularly preferred embodiment, each guide mechanism can be longer by at least the length of the longest ammunition carriage on the guide mechanism than the total length of all of the ammunition carriages on the guide mechanism, whereby the length of an ammunition carriage is measured in the direction of displacement. The guide mechanism should at least be longer by the length of a rocket container than the total length of all of the ammunition carriages on the guide mechanism. Preferably, identically constructed ammunition carriages are used, so that each guide mechanism is longer by at least one ammunition carriage length than the total length of all ammunition carriages on the guide mechanism. A plurality of rocket containers can also be stored in an appropriately long ammunition carriage.

If the rocket launcher can accommodate two rocket containers, pursuant to a preferred embodiment three ammunition carriages can be disposed on each guide mechanism.

Pursuant to one straightforward embodiment, the ammunition carriages, as traveling carriages, can be displaceably disposed on two guide tracks, which in particular extend linearly and parallel to one another. Furthermore, the ammunition carriages can in particular be provided with four or more rollers, by means of which they can be displaceably disposed on the guide mechanism. An improved guidance can additionally be achieved if the guide mechanism or track has the shape of a U-profile or channel in which the rollers are guided. In an analogous manner, the rollers can also have a U-shaped cross-section and can rest on a rail-shaped guide track. Pursuant to a further analogous embodiment, the guide tracks can also be embodied as roller trains or races on which sliding surfaces of the ammunition carriages rest.

The guide mechanism can include a rack in which a corresponding gear wheel or toothed wheel of the ammunition carriage engages, so that the ammunition carriage can be shifted manually or by a motor on the guide mechanism. Pursuant to a preferred embodiment, the ammunition carriages are provided with a crank mechanism by means of which they are displaceable. The crank mechanism can be provided with a No-Back-System that prevents movement of the ammunition carriage as soon as the crank is released. This protects the operating personnel and the ammunition if it becomes necessary to let go of the crank due to severe movements of the ship.

To provide protection against sea and weather conditions, the ammunition compartment can be disposed in a hangar on the deck of the ship behind the rocket launcher. In this connection, the hangar can have an opening that faces the rocket launcher and that can be closed off, so that during the firing of rockets, the particle stream does not pass into the hangar. The roof of the hangar can additionally be provided with an opening for emergency unloading of the rocket containers if, for example, the normal lifting mechanism becomes defective.

Further specific features of the present invention will be described in detail subsequently.

DESCRIPTION OF SPECIFIC EMBODIMENTS

Referring now to the drawings in detail, FIG. 1 shows a weapon system having a rocket launcher 1 in the parked position on a deck 5 of a ship. The ammunition compartment 2, in which the ammunition is stored, is disposed behind the rocket launcher 1 and is surrounded by a hangar 3. The operating personnel 7 can pass through the doors 4 or the hatches 8 into the hangar 3. The rocket launcher 1 is mounted so as to be pivotable in azimuth and elevation. The pivot range 6 extends partially through the hangar 3, which for this reason has an opening, facing the rocket launcher 1, that can be closed off during rocket firing. The ammunition compartment 2 is designed in such a way that a plurality of rocket containers 10 can be stored. The rocket launcher 1 is designed such that it can accommodate two rocket containers 10. In FIG. 1, four rocket containers 10 are disposed on the ship deck 5 at prescribed positions, so that they can be transported via the rocket launcher 1 into the ammunition hangar. The positions are characterized by retaining elements 40 that are detachably mounted in the base of the ship deck and are illustrated in FIG. 2.

Figure 2:
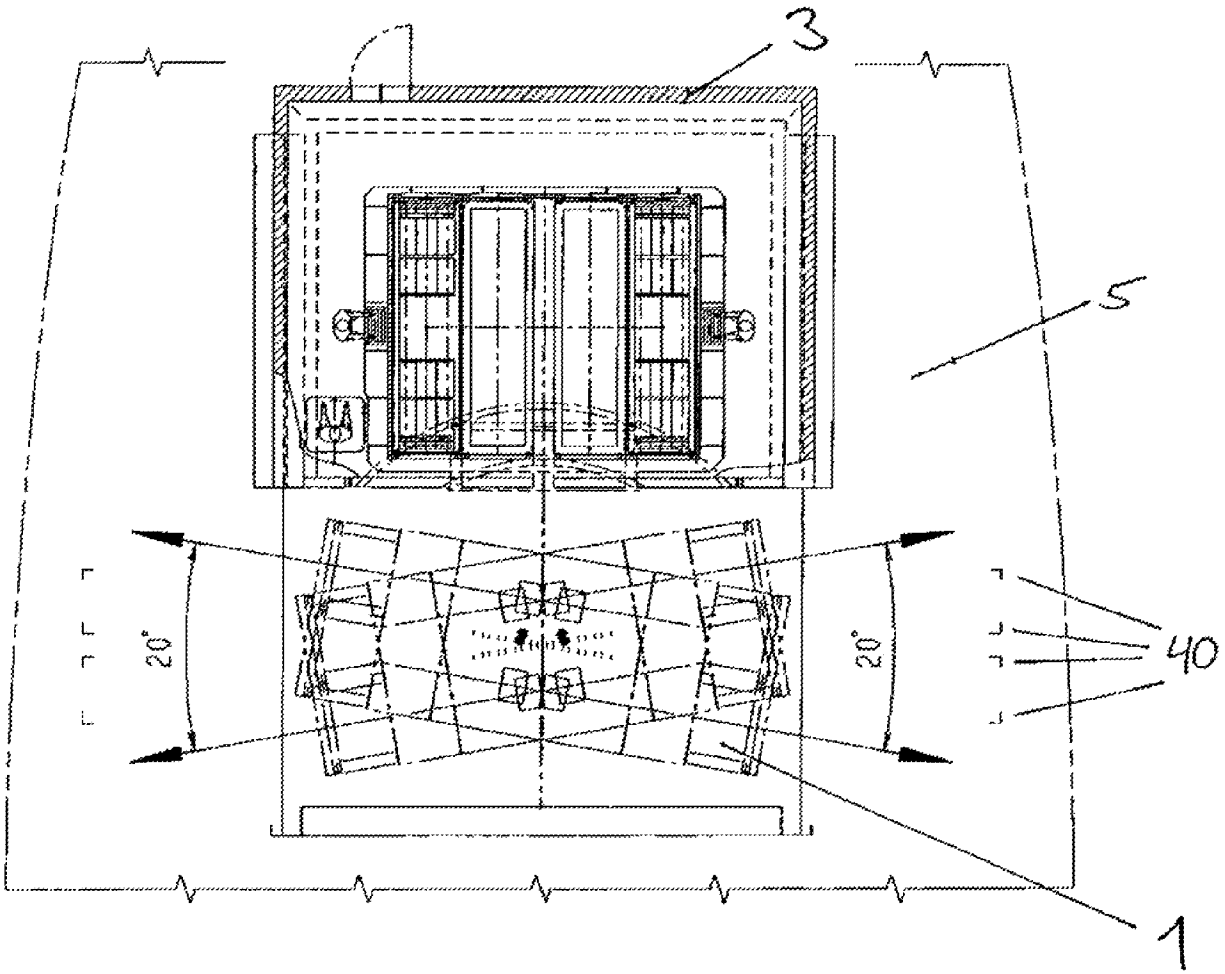
FIG. 2 shows the weapon system of FIG. 1 with the rocket launcher in the firing position.

FIG. 2 shows the rocket launcher 1 in two possible firing positions. The firing range extends over an azimuth angular range of 20%.

Figure 3:
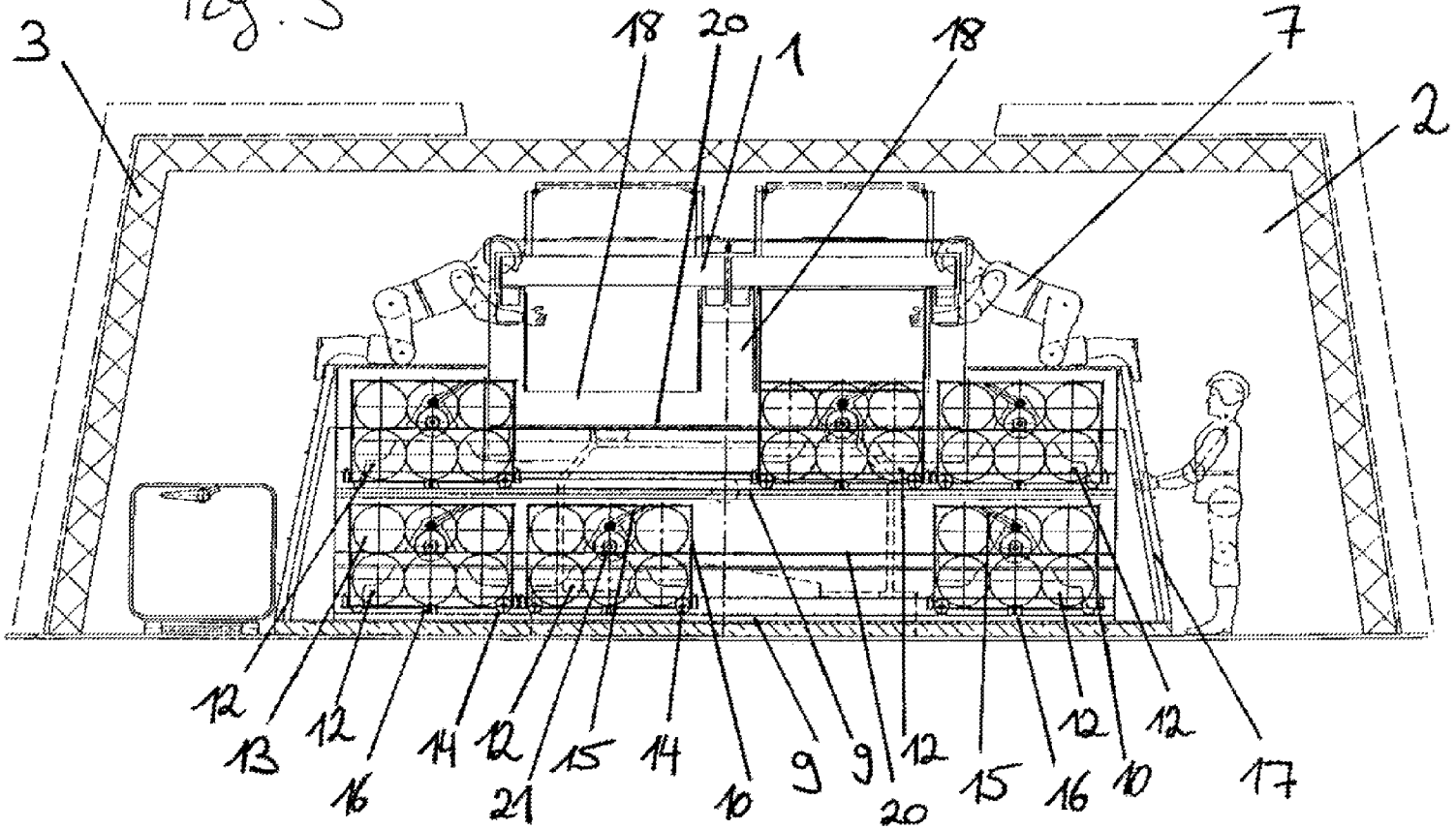
FIG. 3 is a cross-sectional view of the ammunition compartment of FIG. 1.

FIG. 3 is a cross-sectional view of the ammunition compartment 2. In the ammunition compartment 2, six identically-constructed ammunition carriages 12 are disposed in two planes, and are configured for accommodating the rocket containers 10. Six rockets 13 are disposed in each rocket container 10. Each of the ammunition carriages 12 is provided with four rollers 14, which are displaceably guided in the U-profile or channels of the guide tracks 9. The ammunition carriages 12 are provided with a crank mechanism 15 that is connected with a pinion or gear wheel 21, which engages in a rack 20. Thus, the ammunition carriages 12 can be manually shifted via the crank mechanism 15 by operating personnel 7. The ammunition carriages 12 are protected by means of bolts 16, which have a manual knob 24 (FIG. 8), as a securing means against accidental shifting, for example due to heavy seas or swells.

Figure 4:
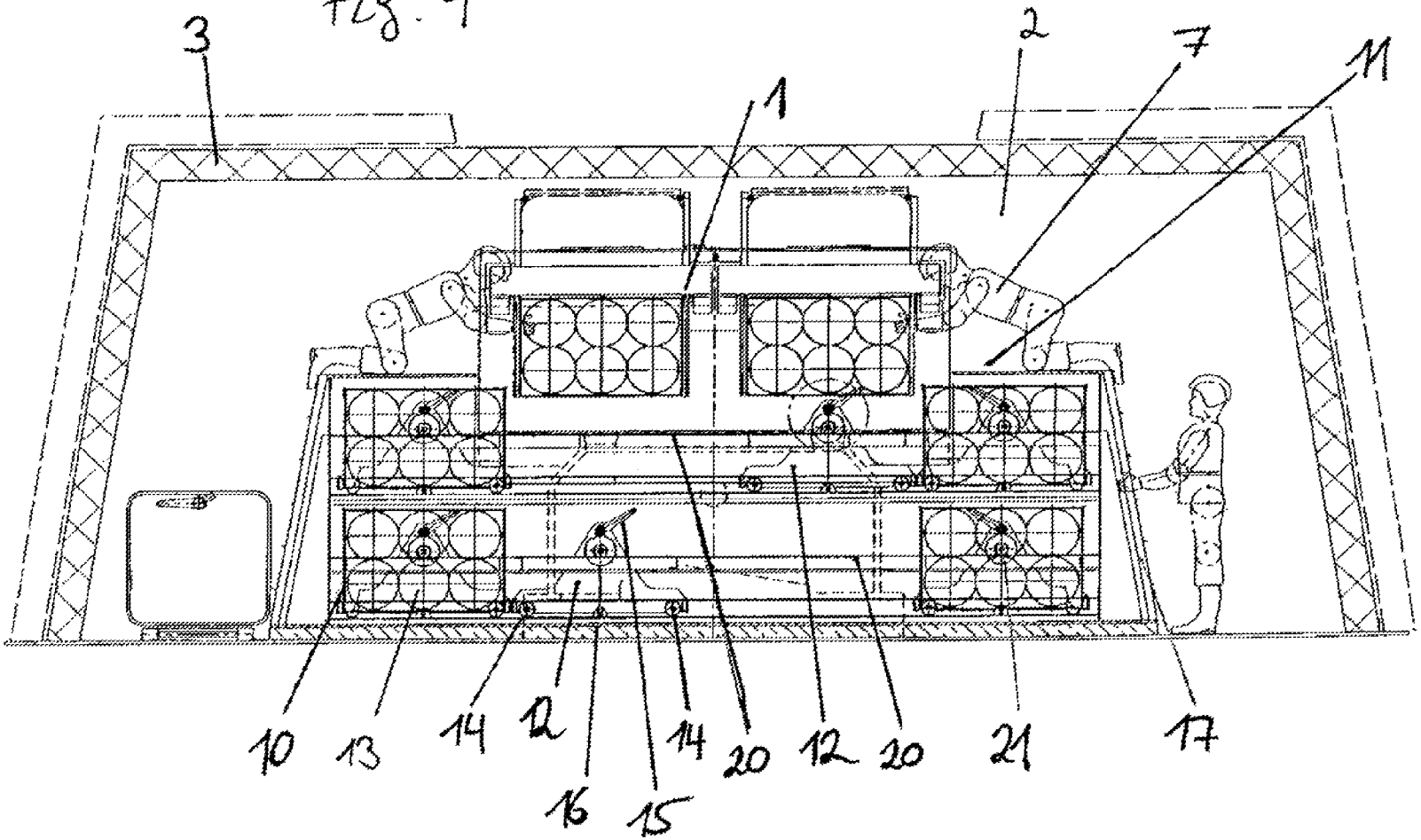
FIG. 4 shows the ammunition compartment of FIG. 3 during loading of the rocket launcher.

To load the rocket launcher 1, the rocket containers 10 must be inserted into the rocket launcher 1. For this purpose, they must first be raised by a crane 19, illustrated in FIG. 5, from the ammunition carriages 12, which are disposed in the loading position, to the height or level of the slide-in structure 18. The raised rocket containers 10 are illustrated in FIG. 4. In this position, the rocket containers 10 can be introduced into the slide-in structure 18 of the rocket launcher 1, and into the prescribed position, by operating personnel, who have reached the working platform 11 via the ladders 17.

When a rocket container 10 has been emptied as a result of firing, the rocket launcher 1 rotates out of the firing position back into the parked position. The rocket container 10 is lowered, and is placed upon an empty ammunition carriage 12. The ammunition carriage 12 with the empty rocket container 10 is cranked to the side, with the bolt 16 pulled out, and is subsequently again lashed via the bolt 16. An ammunition carriage 12 having a full rocket container 10 is brought out of a parked position into the loading position, essentially below the slide-in structure 18, so that the rocket launcher 1 can be loaded with the rocket container 10.

The ammunition compartment 2 is constructed in such a way that all of the stored rocket containers 10 can be supplied to the rocket launcher 1. For this reason, each guide track 9, on which three respective ammunition carriages 12 are disposed, has a length equal to the length of four ammunition carriages, so that always at least one ammunition carriage 12 can be shifted over at least its own length. This ensures that also the outer ammunition carriages 12 can be brought out of the parked position into the loading position.

Figure 5:
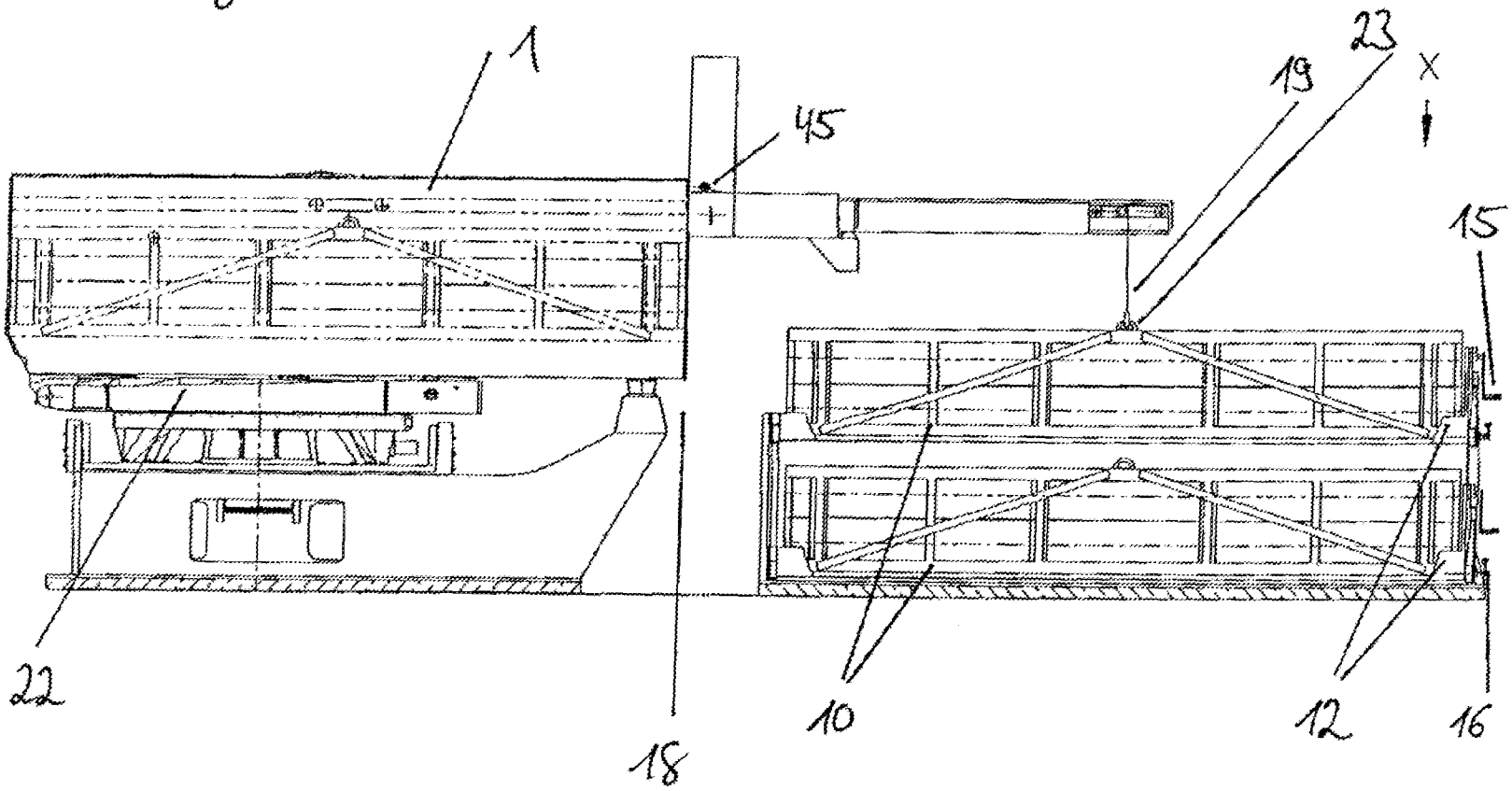
FIG. 5 is a side view of the weapon system of FIG. 1.

FIG. 5 is a side view of the weapon system without the hangar 3. A crane 19 having a telescopic arm or boom and disposed on the rocket launcher 1 engages via a hook in an eye or ring 23 of the rocket container 10 and raises it from the ammunition carriage 12. By means of a cable 45, the rocket containers 10 can be completely introduced into the rocket launcher 1. The rocket launcher is mounted on a platform 22 that can pivot the rocket launcher 1 in elevation and azimuth.

Figure 6:
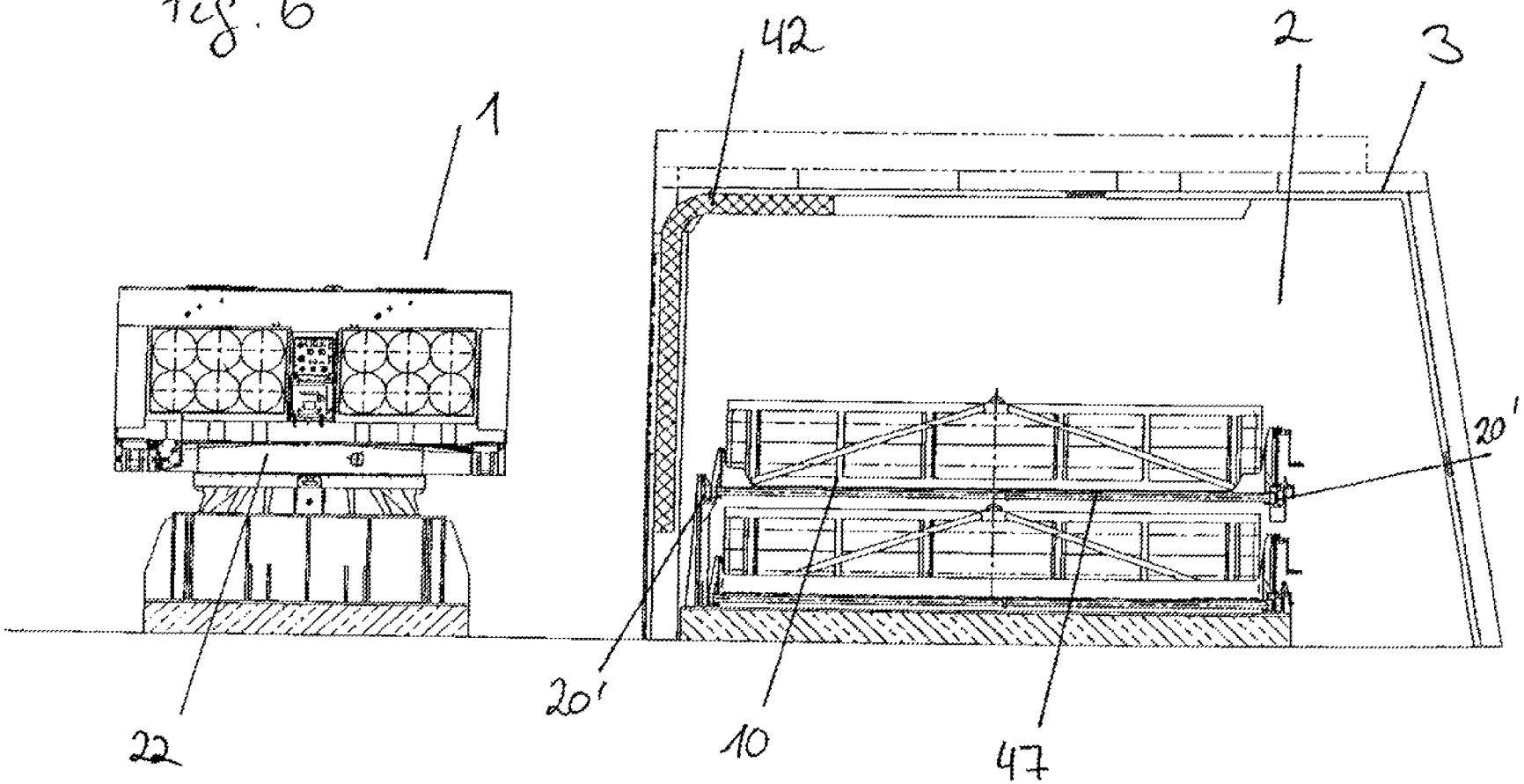
FIG. 6 shows the weapon system of FIG. 5 with the rocket launcher in the firing position.

FIG. 6 shows the rocket launcher 1 in a prescribed firing position. To protect the ammunition compartment 2 from particles during the firing process, a rolling window 42 is brought in front of the opening of the hangar 3. The weapon system illustrated in FIG. 6 is shown slightly altered from the preceding illustrations. To ensure a shifting that is free of canting or tilting, the ammunition carriage 12 is mounted on racks 20' that are disposed on both sides of the ammunition carriage 12 and in which engage two corresponding gear wheels that are connected to one another by a shaft 47 that is disposed below the ammunition carriage 12.

Figure 7:
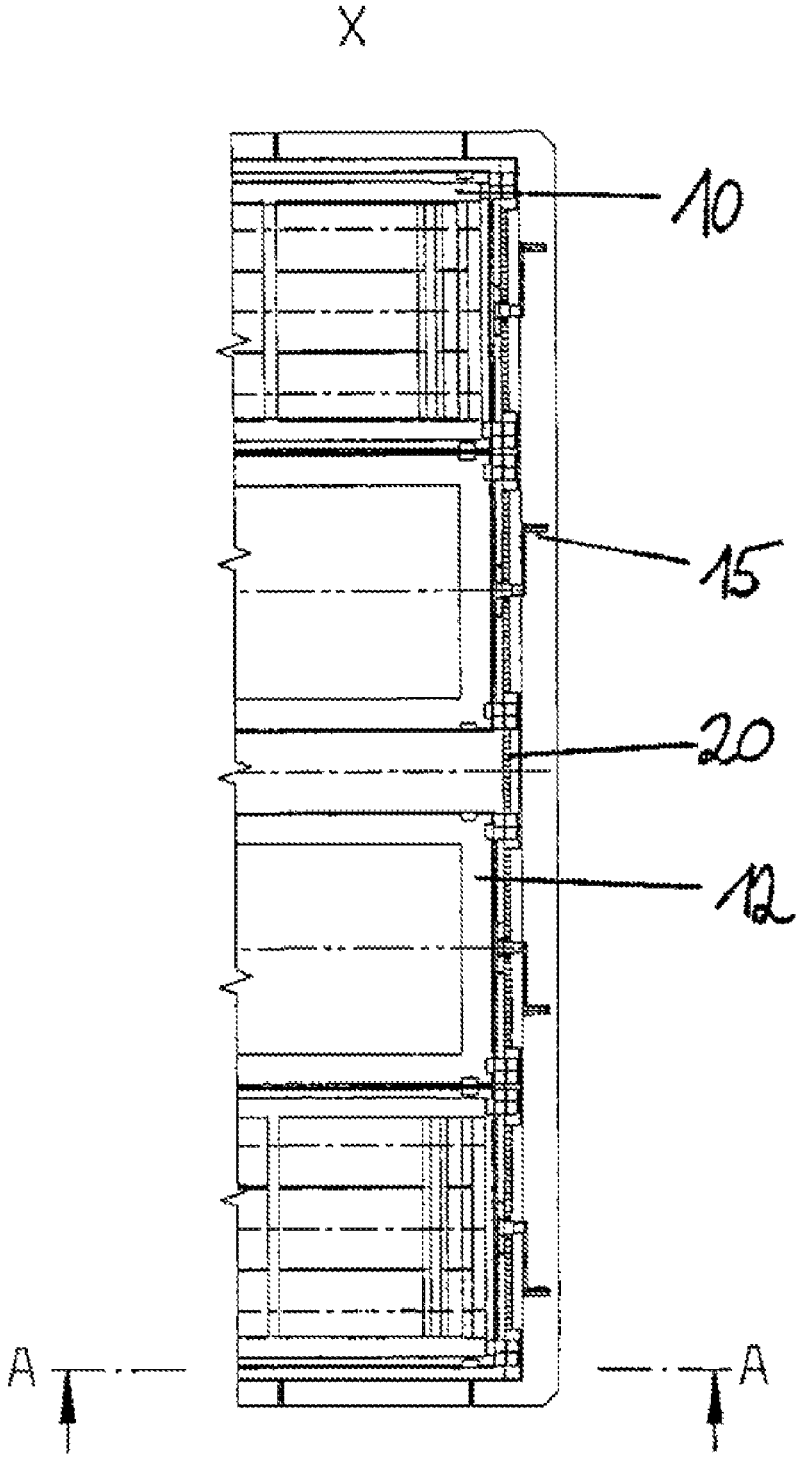
FIG. 7 is a plan view of a portion of the ammunition compartment taken in the direction of the arrow X in FIG. 5.

FIG. 7 is a plan view of a portion of the weapon system, and shows the tooth profile of the rack 20 in which the corresponding gear wheels 21 of the ammunition carriage 12 engage.

Figure 8:
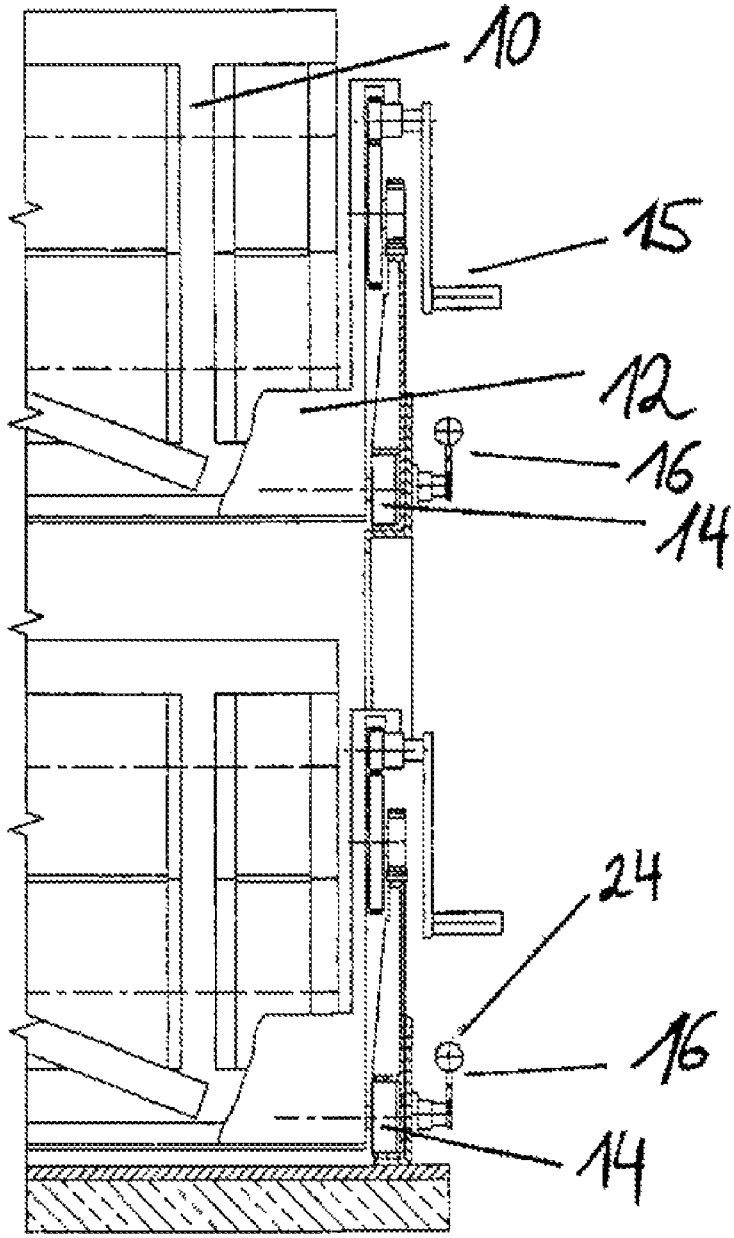
FIG. 8 is a cross-sectional view of a portion of the ammunition compartment taken along the section line A-A in FIG. 7.

FIG. 8 shows the rollers 14 of the ammunition carriage 12 that run in a channel. The shifting of the ammunition carriage is effected via a crank mechanism 15 that has a No-Back-System.

Figure 9:
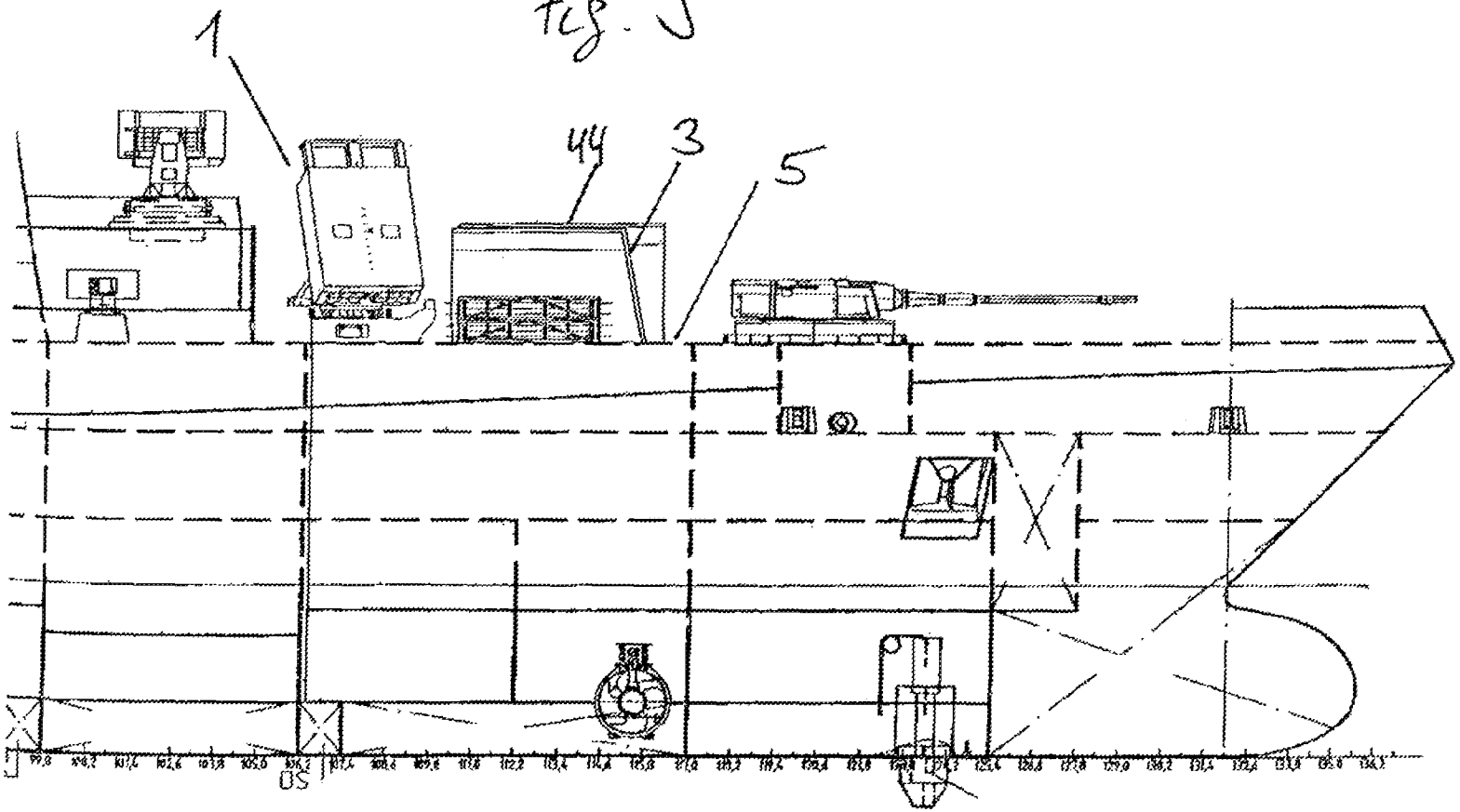
FIG. 9 shows the weapon system of FIG. 1 disposed on a ship, with the rocket launcher in the firing position.
Figure 10:
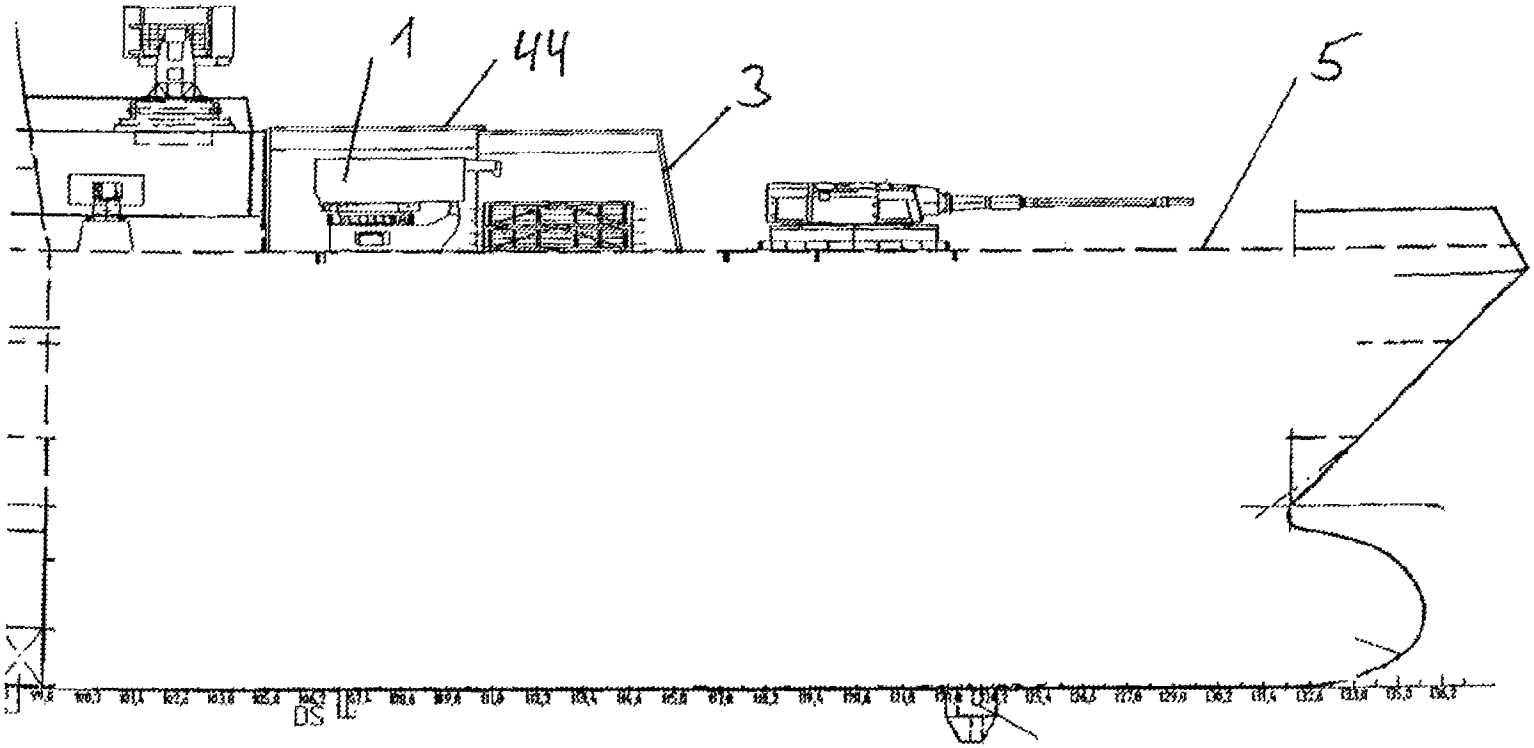
FIG. 10 shows the weapon system of FIG. 9 on a ship, with the rocket launcher in the parked position.

FIGS. 9 and 10 illustrate the arrangements of the weapon system on the deck 5 of a ship, whereby the rocket launcher 1 is in the firing position or in the parked position respectively. If the rocket launcher 1 is in the parked position (FIG. 10), a covering 44 is placed over the rocket launcher 1 to protect against external influences.

The specification incorporates by reference the disclosure of German priority document DE 10 2006 037 337.5 10 Aug. 2006.

The present invention is, of course, in no way restricted to the specific disclosure of the specification and drawings, but also encompasses any modifications within the scope of the appended claims.

What we claim is:

1. A weapon system, comprising:

a rocket launcher having a slide-in structure;

an ammunition compartment for storing rocket containers designed to each accommodate at least one rocket;

a guide mechanism disposed in said ammunition compartment;

at least two ammunition carriages designed to accommodate said rocket containers with said at least one rocket disposed therein, wherein said at least two ammunition carriages are displaceably disposed on said guide mechanism and are adapted to be shifted out of a parked position into a loading position in which said rocket container is disposed essentially below said slide-in structure of said rocket launcher;

a crane for raising of said rocket containers, wherein said crane is disposed on said rocket launcher, securing means for securing said ammunition carriages in place on said guide mechanism; and at least two guide mechanisms that are disposed one above the other, wherein at least two ammunition carriages are displaceably disposed on each of said guide mechanisms, and wherein each of said guide mechanisms is longer by at least a length of a longest one of said ammunition carriages on said guide mechanism than a total length of all of said ammunition carriages on said guide mechanism.

2. A weapon system according to claim 1, wherein three ammunition carriages are disposed on each of said guide mechanisms, and wherein said rocket launcher is adapted to accommodate two rocket containers.

3. A weapon system according to claim 1, wherein said guide mechanism includes two guide tracks.

4. A weapon system according to claim 3, wherein said guide tracks extend linearly and parallel to one another.

5. A weapon system according to claim 1, wherein said ammunition carriages are provided with rollers via which said ammunition carriages are displaceably disposed of said guide mechanism.

6. A weapon system according to claim 5, wherein said ammunition carriages are provided with at least four rollers.

7. A weapon system according to claim 5, wherein said guide mechanism (9) has a channel configuration in which said rollers are guided.

8. A weapon system according to claim 1, wherein said guide mechanism includes a rack, and wherein said ammunition carriage is provided with a corresponding gear wheel that engages in said rack.

9. A weapon system according to claim 1, which includes means via which said ammunition carriages are adapted to be manually displaceable on said guide mechanism.

10. A weapon system according to claim 9, wherein said means comprises a crank mechanism disposed on said ammunition carriages for displacement thereof.

11. A weapon system according to claim 1, which includes motorized means adapted to displace said ammunition carriages.

12. A weapon system according to claim 1, which includes a hangar, wherein said ammunition compartment is disposed in said hangar.

13. A weapon system according to claim 12, wherein said hangar is provided with a closable opening that faces said rocket launcher.

14. A weapon system according to claim 12, wherein said hangar has a roof that is provided with an opening for an unloading of said rocket containers.

* * * * *

UNITED STATES PATENT AND TRADEMARK OFFICE

CERTIFICATE OF CORRECTION

PATENT NO. : 7,878,101 B2
APPLICATION NO. : 11/836708
DATED : February 1, 2011
INVENTOR(S) : Heldmann et al.

It is certified that error appears in the above-identified patent and that said Letters Patent is hereby corrected as shown below:

On the Title Page, Item (54) and Col. 1 lines 1-4
The title is incorrectly shown as "Weapon Storage and Loading System With Rocket Launcher and Ammunition Compartment for Storing Rocket Containers"

The correct title is "Weapon System"

Signed and Sealed this
Twenty-second Day of March, 2011

David J. Kappos

David J. Kappos
*Director of the United States Patent and Trademark Office*